United States Patent [19]

Cybulsky et al.

[11] Patent Number: 4,683,936

[45] Date of Patent: Aug. 4, 1987

[54] CONTROLLED SOLIDIFICATION, METHOD OF DISTRIBUTING STRENGTHENING ADDITIVES AND MAINTAINING A CONSTANT MELT LEVEL

[75] Inventors: Michael Cybulsky, Mentor; Thomas S. Piwonka, Solon; Virgil R. Brittain, Mentor, all of Ohio

[73] Assignee: TRW Inc., Cleveland, Ohio

[21] Appl. No.: 862,168

[22] Filed: May 8, 1986

Related U.S. Application Data

[63] Continuation of Ser. No. 610,890, May 16, 1984, abandoned.

[51] Int. Cl.[4] ..... B22D 27/00

[52] U.S. Cl. ..... 164/122.1; 164/133; 164/97

[58] Field of Search ..... 164/55.1, 58.1, 97

[56] References Cited

U.S. PATENT DOCUMENTS

| | | | |
|---|---|---|---|
| 2,822,308 | 2/1958 | Hall | 164/122.2 |
| 3,025,146 | 3/1962 | Runyan . | |
| 3,340,925 | 9/1967 | Woodburn, Jr. . | |
| 3,543,284 | 11/1970 | Sink et al. | 164/122.2 |
| 3,678,988 | 7/1972 | Tien et al. . | |
| 3,690,367 | 9/1972 | Daniels | 164/122.1 |
| 3,763,926 | 10/1973 | Tschinkel et al. . | |
| 4,175,609 | 11/1979 | El Gammal et al. | 164/122.2 |
| 4,190,094 | 2/1980 | Giamei | 164/122.1 |
| 4,307,769 | 12/1981 | Hauser et al. | 164/122.1 |
| 4,340,108 | 7/1982 | Chandley et al. | 164/133 |
| 4,412,577 | 11/1983 | Salkeld et al. | 164/122.1 |

FOREIGN PATENT DOCUMENTS

| | | | |
|---|---|---|---|
| 46-42308 | 12/1971 | Japan | 164/122.1 |
| 931289 | 5/1982 | U.S.S.R. | 164/133 |

*Primary Examiner*—Nicholas P. Godici
*Assistant Examiner*—G. M. Reid
*Attorney, Agent, or Firm*—Tarolli, Sundheim & Covell

[57] ABSTRACT

To cast an article, a mold is lowered into a body of molten metal with an open end of the mold facing downwardly so that the molten metal fills a mold cavity. The mold is then withdrawn form the body of molten metal. As the mold is withdrawn, the molten metal in the mold cavity is solidified. During withdrawal of the mold from the body of molten metal, the level of the upper surface of the body of molten metal is maintained substantially constant. The economical production of castings is promoted by simultaneously lowering a plurality of molds into the molten metal and withdrawing them from the molten metal to simultaneously form a plurality of castings. A strengthening agent may be added to the molten metal by dispensing the strengthening agent to form a dispersoid a short distance beneath the surface of the molten metal as the mold is withdrawn from the molten metal.

22 Claims, 13 Drawing Figures

CONTROLLED SOLIDIFICATION, METHOD OF DISTRIBUTING STRENGTHENING ADDITIVES AND MAINTAINING A CONSTANT MELT LEVEL

This is a continuation of copending application Ser. No. 610,890 filed on May 16, 1984 now abandoned.

BACKGROUND OF THE INVENTION

The present invention relates to a new and improved method and apparatus for casting articles. Although the method and apparatus can be used for casting many different types of articles, it is advantageously used for the casting of airfoils from nickel-chrome super alloys. The airfoils may be cast with a single crystal, equiaxed, or columnar grain crystal structure.

Airfoils which are used in gas turbine engines have previously been cast from nickel-chrome super alloys. The specific nickel-chrome super alloy used in casting the airfoil depends upon the desired characteristics for the airfoil. However, the nickel-chrome super alloy may have a composition generally similar to that disclosed in U.S. Pat. Nos. 3,260,505 or 4,371,404.

Ceramic molds formed by the lost wax process have previously been used to cast nickel-chrome super alloy airfoils. These ceramic molds are preheated to a relatively high temperature in a furnace. A super heated molten metal is then poured into the preheated molds.

The mold is then lowered from the furnace and cooled. As the molten metal in the mold cools, an airfoil having a desired crystal structure is formed. The furnace may have a construction generally similar to that shown in U.S. Pat. Nos. 3,841,384; 3,895,672; 3,897,815; and 4,178,986. It has been suggested that the mold could be immersed in a body of liquid coolant as it is withdrawn from the furnace in the manner disclosed in U.S. Pat. Nos. 3,763,926 and 4,108,236.

In an effort to obtain economical production, molds have been poured in clusters or groups. When this is done, the molten metal flows from a pour cup through a runner system to individual molds arranged in a circular array about the pour cup. It has also been suggested that individual molds could be moved along a horizontal path through a furnace to sequentially cast articles in the manner shown in U.S. Pat. No. 3,677,324.

In order to improve the characteristics of a cast article, it has been suggested that inert particles could be dispersed in molten metal in a mold by the use of ultrasonic waves in the manner disclosed in U.S. Pat. No. 3,678,988. In practicing the method disclosed in this patent, a tube is inserted into the mold. The inert particles are carried through the tube into the molten metal by a flow of gas. After the particles have been dispersed within the molten metal, the tube is withdrawn and ultrasonic vibrations are set up in the molten metal. The molten metal is then solidified.

BRIEF SUMMARY OF THE PRESENT INVENTION

When an article is to be cast by the method of the present invention, a mold is lowered into a body of molten metal with an open end of the mold cavity facing downwardly. This results in the mold cavity filling with molten metal as the mold is lowered. After thermal equilibrium has been obtained between the molten metal and the mold, the mold is slowly withdrawn from the body of molten metal. As the mold is withdrawn, the molten metal solidifies in the mold cavity to form the cast article. To provide for controlled solidification of the molten metal in the mold cavity, the level of the upper surface of the body of molten metal is maintained substantially constant as the mold is withdrawn from the body of molten metal.

The characteristics of the casting may be enchanced by additives dispensed into the molten metal in the mold cavity. These additives are dispensed into the molten metal to form a dispersoid immediately beneath the surface of the molten metal in the mold cavity as the mold is withdrawn from the body of molten metal. This results in an even dispersion of the additive in the metal which is solidifying as the mold is withdrawn from the body of molten metal.

In order to obtain economical production of castings, a plurality of articles may be simultaneously cast. When this is done, a plurality of molds are connected to a mold support member with open ends of chill cavities facing in one direction and open ends of mold cavities facing in the opposite direction. The mold support member is then connected to a chill assembly with an end portion of a chill extending into each of the chill cavities. The mold cavities are then filled with molten metal and the chills are cooled to promote solidification of the molten metal in a direction away from the chills.

Accordingly, it is an object of this invention to provide a new and improved method and apparatus for casting an article and wherein a mold is lowered into a body of molten metal with an open end of a mold cavity facing downwardly, the molten metal in the mold cavity solidifies to form a cast article as the mold is withdrawn from the body of molten metal.

Another object of this invention is to provide a new and improved method and apparatus for simultaneously casting a plurality of articles and wherein molds are connected to a support member with open ends of mold cavities facing in one direction and open ends of chill cavities facing in the opposite direction, the support member is then connected to a chill assembly with an end portion of a chill extending into each of the chill cavities, and, thereafter, the mold cavities are filled with molten metal which is solidified to form cast articles.

Another object of this invention is to provide a new and improved method and apparatus for casting an article and wherein an additive is added to molten metal in a mold cavity adjacent to an interface between the molten metal and solid metal in the mold cavity to promote an even distribution of the additive in the resulting casting.

BRIEF SUMMARY OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Casting Method—General Description

Figure 2:
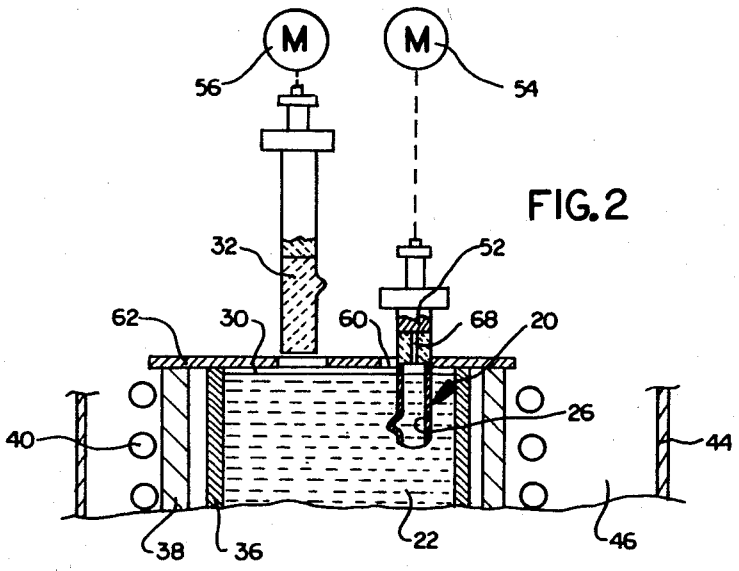
FIG. 2 is a fragmentary schematic illustration, generally similar to FIG. 1, illustrating the mold partially lowered into the body of molten metal.
Figure 3:
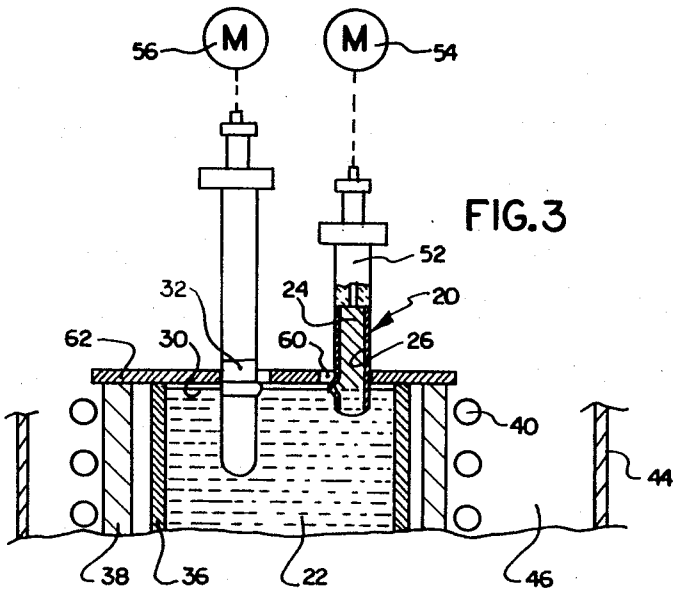
FIG. 3 is a fragmentary schematic illustration, generally similar to FIG. 2, illustrating withdrawal of the mold from the body of molten metal and lowering of a member into the body of molten metal to maintain the level of the molten metal substantially constant as the mold is withdrawn.

In accordance with one of the features of the present invention, an article, such as a blade or vane for a turbine engine, is cast by a method which includes lowering an open ended ceramic mold 20 (FIG. 1) into a super heated body 22 of molten metal (FIG. 2). The mold 20 is then withdrawn from the molten metal (FIG. 3). As the mold is withdrawn, a solid cast article 24 is formed in the open ended mold cavity 26. In order to maintain an upper surface 30 and body 22 of molten metal at a substantially constant level as the mold 20 is withdrawn, a metal level adjustment member or dummy mold 32 is lowered into the body 22 of molten metal as the mold 20 is withdrawn from the body of molten metal.

The body 22 of molten metal is a nickel-chrome super alloy of the same general type disclosed in U.S. Pat. Nos. 3,260,505; 3,635,769; and 4,371,404. The super heated body 22 of molten metal is held in a cylindrical crucible 36 formed of zircon or other suitable ceramic material. The crucible 36 is disposed within a graphite susceptor 38. The body 22 of molten metal is heated by an induction coil 40.

The crucible 36 is supported on a table 42 which is movable vertically relative to a furnace wall 44. The furnace wall 44 encloses the crucible 36 and mold 20 in a chamber 46. The furnace chamber 46 is connected in fluid communication with a source of low pressure or vacuum so that there is little or no gas within the chamber.

The upper end of the mold 20 is connected with a water cooled chill 52. The chill 52 may be formed of copper or any other suitable material. The chill 52 and mold 20 can be raised and lowered relative to the crucible 36 by operation of a suitable motor 54. Similarly, the dummy mold 32 can be raised and lowered by operation of a motor 56. If desired, the drive arrangement for the dummy mold 32 and mold 20 could be interconnected through a gear box.

Figure 1:
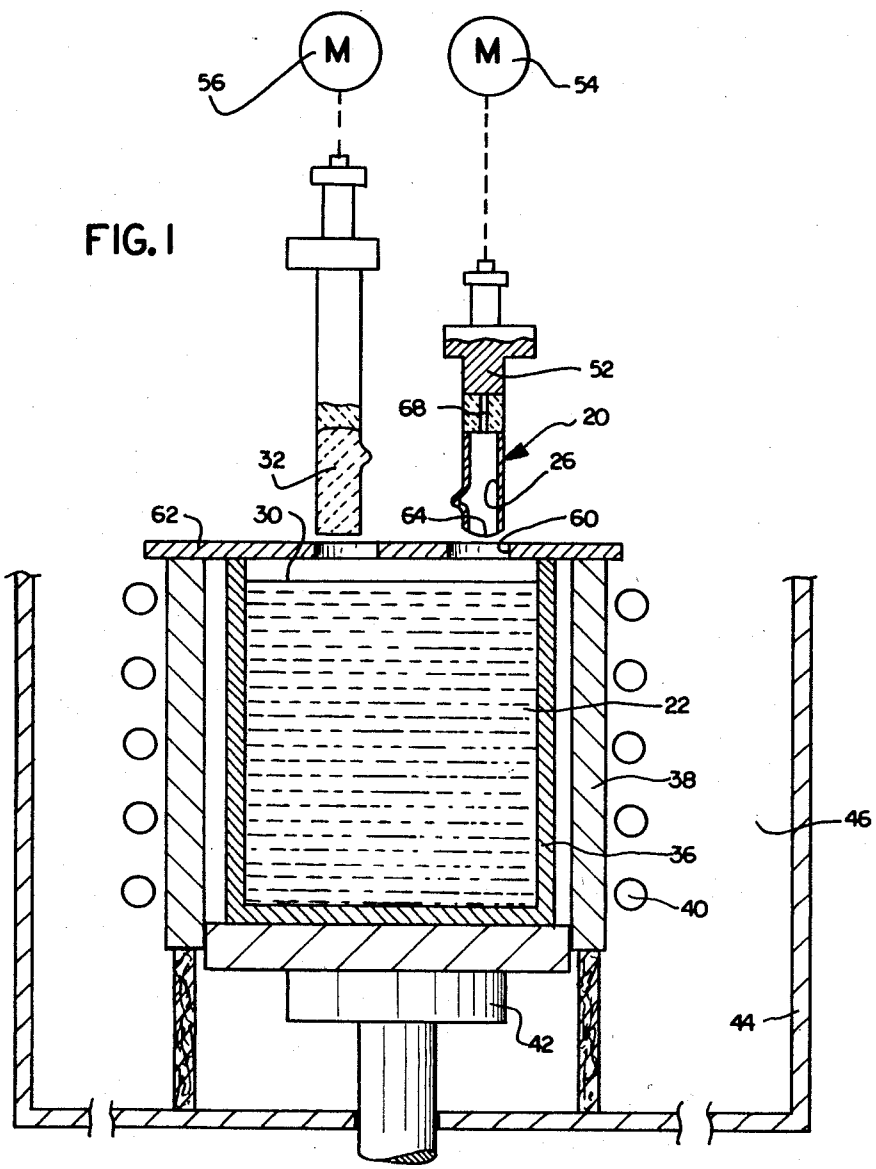
FIG. 1 is a schematic illustration of a casting apparatus which is constructed and operated in accordance with the present invention, an open ended mold being shown directly above a body of molten metal.

When an article is to be cast in the mold cavity 26, the mold 20 is lowered from the retracted position shown in FIG. 1. As the mold 20 moves downwardly, the mold moves through an opening 60 formed in a refractory baffle plate 62 disposed above the body 22 of molten metal. The baffle plate 60 retards the transfer of heat from the body 22 of the molten metal to the furnace chamber 46. Therefore, the baffle plate 60 helps to establish a temperature gradient so that it is substantially cooler above the baffle plate.

As the mold is lowered through the baffle plate opening 60, an opening 64 (FIG. 1) at the lower end of the mold cavity 26 moves downwardly into the body 22 of molten metal. As the mold 20 moves downwardly, the mold cavity 26 fills with molten metal. Since the furnace chamber 46 has been evacuated, there is relatively little gas which can be trapped in the mold cavity 26 above the molten metal 22 to oppose entry of molten metal into the mold cavity. Whatever gas may be present can leave the mold cavity 26 through the gas permeable walls of the ceramic mold 20. However, if desired, a vent passage could be provided at the upper end of the mold cavity 26 to enable any gases which are present in the mold cavity to escape.

After the mold 20 has been lowered to a level at which the upper surface 30 of the body 22 of molten metal is just slightly beneath a passage 68 leading to the chill 52, downward movement of the mold 20 is interrupted (FIG. 2). The mold 20 is maintained in the partially immersed condition shown in FIG. 2 until the temperature of the mold 20 is the same as that of the super heated molten metal 22. By using the molten metal 22 to heat the mold 20, the necessity of a second power source for preheating the mold is eliminated. Of course, the mold 20 could be preheated somewhat before it is lowered into the molten metal 22 in order to minimize thermal stress on the mold.

Once the mold 20 has been heated to the same temperature as the super heated molten metal 22, the mold is lowered still further until the molten metal flows through the passage 68 and engages the water cooled copper chill 52 at the upper end of the mold 20. When this happens, the molten metal solidifies downwardly through the passage 68 into the mold cavity 26. By properly sizing and/or configuring the passage 68, only a single crystal of metal may emerge from the passage and solidify as a single crystal article in the mold cavity 26. Thus, the passage 68 could have a helical configuration in a manner similar to that shown in U.S. Pat. No. 4,111,252 in order to provide for the growth of only a single crystal into the mold cavity 26.

If it is desired to cast an article with a columnar grain structure, the passage 68 would be eliminated and the upper end of the mold cavity 26 would be exposed directly to the water cooled chill 52. When the molten metal engages the water cooled chill 52, a large number of grains are nucleated and grow downwardly through the mold cavity 26 as the mold 20 is raised. This results in an article having an elongated columnar grain crystal structure. Of course, if an equiaxed structure was desired, the chill 52 would be eliminated.

In order to form the cast article 24 in the mold cavity 26 with a desired crystallographic structure, the motor 54 is operated to slowly raise the mold 20. As the mold 20 is raised, it moves upwardly out of the body 22 of molten metal and is cooled as it moves through the refractory baffle plate 62. Thus, as the mold 20 is slowly raised by operation of the motor 54, a liquid-solidus interface occurs in the mold cavity 26 at approximately the level of the upper surface 30 of the body 22 of molten metal. As the mold 20 continues to be withdrawn through the opening 60, the molten metal in the mold cavity 26 solidifies to form the cast article 24.

In order to provide for a controlled rate of solidification of the molten metal in the mold cavity 26, the upper surface 30 of the body 22 of molten metal is maintained at the same level as the mold 20 is withdrawn. To accomplish this, the solid ceramic dummy mold 32 is lowered at the same rate as the mold 20 is raised. The dummy mold 32 has a cross sectional volume which varies from the lower end of the dummy mold to the upper end of the dummy mold in the same manner as in which the cross sectional volume of the article mold 20 varies from the upper end to the lower end of the mold.

As the article mold 20 is raised through an incremental distance, the dummy mold 32 is lowered through an equal incremental distance. The volume of the article mold and solidified metal which is removed from the body 22 of molten metal for each increment of upward movement of the article mold 20 is equal to the volume of the dummy mold 32 which is lowered into the body of molten metal by the corresponding increment of downward movement of the dummy mold. Therefore, the level of the upper surface 30 of the body 22 of molten metal remains constant as the article mold 20 is withdrawn. This is accomplished by merely lowering the solid ceramic dummy mold 32 into the body 22 of molten metal. It is not necessary to add makeup metal to the body 22 of molten metal at this time.

Since the level of the upper surface 30 of the body of molten metal 22 remains constant as the article mold 20 is withdrawn, the liquidus solidus interface between the solid and molten metal in the mold cavity 26 remains at the same level, that is, at approximately the same level as the upper surface 30 of the body 22 of molten metal. This results in a controlled rate of solidification of the molten metal in the mold cavity 26 as the mold 20 is slowly withdrawn from the body 22 of molten metal. After a mold 20 has been fully withdrawn from the body 22 of molten metal, the ceramic dummy mold 32 is withdrawn and makeup metal is added to the crucible 36.

Although the use of a dummy mold 32 formed of a suitable refractory material has been illustrated in FIGS. 1–3 to maintain the level of the upper surface 30 of the body 22 of molten metal constant as the mold 20 is withdrawn, it is contemplated that the level of the upper surface 30 of the body 22 of molten metal could be maintained constant by adding metal to the crucible 36 if desired. Thus, either solid or molten metal could be added to the crucible 22 at a rate which maintains the level of the upper surface 30 of the molten metal constant as the mold 20 is withdrawn. Although it is preferred to lower the mold 20 into the body 22 of molten metal by moving the mold 20 downwardly, it is contemplated that the crucible 26 could be raised to lower the mold into the body 22 of molten metal. Similarly, although it is preferred to withdraw the mold 20 from the body 22 of molten metal by raising the mold, it is contemplated that the mold could be withdrawn from the body 22 of molten metal by lowering the crucible 36.

Production Casting Apparatus

In order to obtain an economical production of airfoils or other cast articles, it is advantageous to simultaneously cast a plurality of the airfoils. Thus, in accordance with another of the features of the present invention, an apparatus 74 (see FIG. 4) can be used to simultaneously cast a plurality of articles, such as airfoils. The apparatus 74 includes a furnace 76 in which a refractory crucible 78 is disposed on a vertically movable support table or platform 80. The crucible 78 is surrounded by a graphite susceptor 84 and an induction coil 86. A furnace chamber 90 in which the crucible 78 is disposed, is connected in fluid communication with a source of vacuum or low pressure through a conduit 92.

Figure 4:
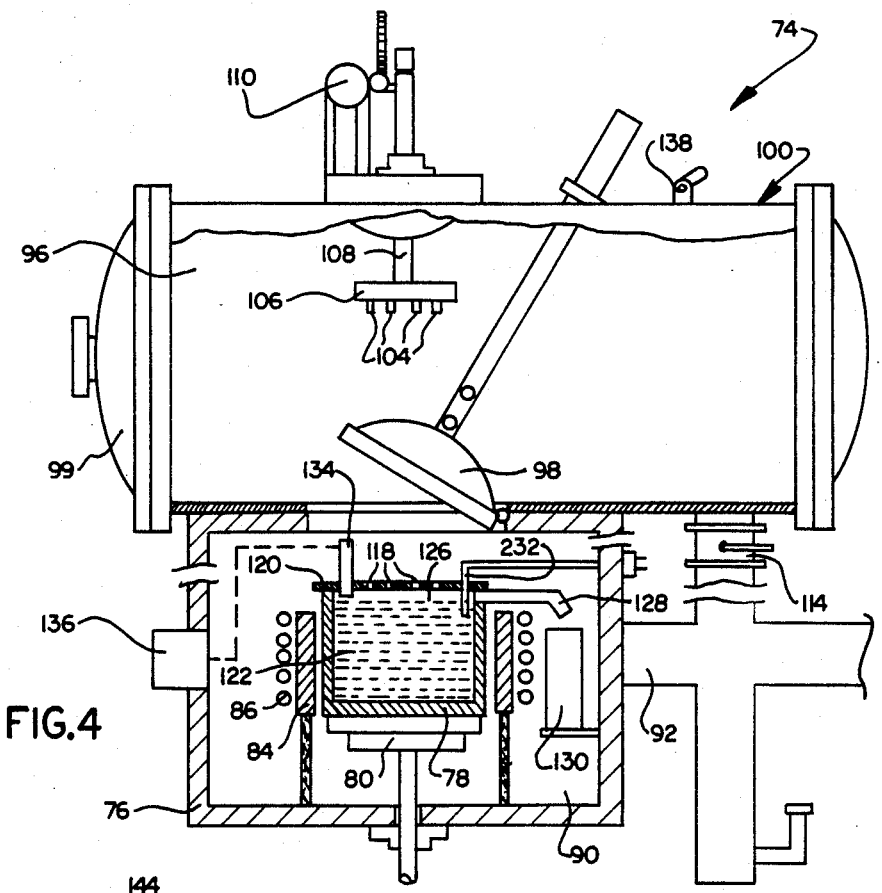
FIG. 4 is a fragmentary sectional view of an apparatus constructed and operated in accordance with the present invention to simultaneously cast a plurality of articles.

A loading chamber 96 is disposed above the furnace 76 and is separated from the furnace by a pivotally mounted isolation valve 98 which is shown in FIG. 4 in a partially open condition. Of course, other methods of mounting the valve 98 could be used if desired. When the isolation valve 98 is closed, the interior of the loading chamber 96 is accessible through a removable end section 99 of a housing 100. An annular array of molds 104 is supported in the loading chamber 96 on a chill assembly 106. The chill assembly 106 is connected with a support post or rod 108 which is vertically movable to raise and lower the chill assembly upon operation of a motor 110.

When the loading chamber door 99 and the isolation valve 98 are closed, a vacuum control valve 114 can be opened to evacuate the loading chamber 96. Once the loading chamber 96 has been evacuated, the isolation valve 98 is opened and the chill assembly 106 is lowered. As the chill assembly 106 is lowered, the molds 104 are moved downwardly through openings 118 disposed in an annular array in a refractory baffle plate 120. As the molds 104 are simultaneously moved downwardly through the openings 118 into a body 122 of molten metal, the mold cavities are filled with the molten metal. As the molds 104 enter the body 122 of molten metal, the level of the upper surface 126 of the molten metal rises and molten metal flows through an overflow conduit 128 into a reservoir 130.

After the molds have reached the temperature of the body 122 of superheated nickel-chrome alloy in the crucible 78, the chill assembly 106 is gradually raised and the molds 104 are withdrawn from the body 122 of molten metal. As the molds 104 are withdrawn, an ingot 134 of the nickel-chrome alloy is lowered by operation of a drive assembly 136. The rate at which the ingot 134 is lowered is sufficient to maintain the level of the upper surface 126 of the body 122 of molten metal constant as the molds 104 are withdrawn. If desired, the level of the upper surface 126 of the body 122 of molten metal could be maintained constant as the molds 104 are withdrawn by adding molten metal to the crucible 78.

Once the chill assembly 106 and molds 104 have been raised upwardly through the fully open isolation valve to the position shown in FIG. 4, the isolation valve 98 is closed. The valve 114 is then closed so that the loading chamber 96 is no longer connected with vacuum. Air is then let into the chamber 96 through a valve 138. The loading chamber door 99 is then opened and the mold can be removed from the loading chamber 96.

Although it is preferred to move the molds 104 downwardly to lower them into the body 122 of molten metal, the molds could be lowered into the molten metal by raising the table 80 and crucible 78. Similarly, while it is preferred to move the molds 104 upwardly to withdraw them from the body 122 of molten metal, the molds could be withdrawn from the molten metal by lowering the table 80 and crucible 78.

Mold Construction

Figure 5:
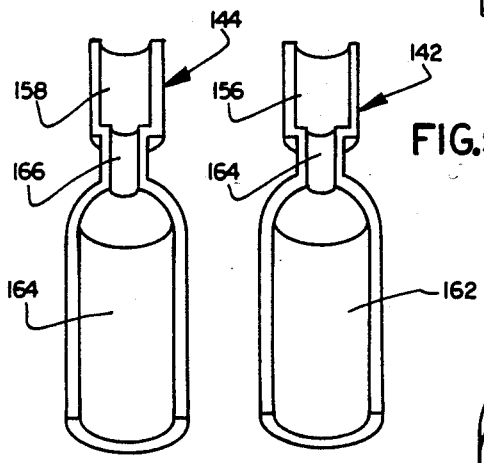
FIG. 5 is an illustration of a pair of mold halves which are interconnected to form a mold used with the apparatus of FIG. 4.
Figure 6:
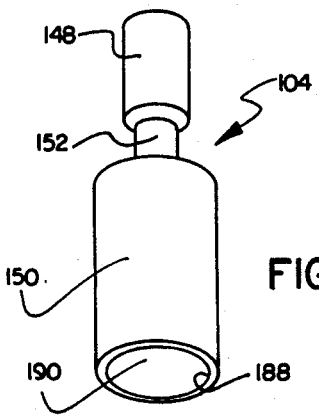
FIG. 6 is a view of the mold halves of FIG. 5 interconnected to form a mold.

The refractory molds 104 can be made in many different ways. However, it is preferred to form the molds from a pair of injection molded shells 142 and 144 (see FIG. 5) formed of a suitable extrudable composition such as vitreous silica, a mineralizer, an organic binder, and a plasticizer and/or tempering fluid. The injection molded shell 142 is bonded to the injection molded shell 144 to form a mold 104 (see FIG. 6).

Each of the molds 104 has a chill cavity section 148 and a mold cavity section 150 (FIG. 6) which are interconnected by a connector section 152. The chill cavity section 148 contains a cylindrical cavity which is formed by a pair of partial cavities 156 and 158 formed in the shell mold sections 142 and 144 (see FIG. 5). Similarly, the article mold cavity section 150 contains a mold cavity having a configuration corresponding to the configuration of the article to be cast.

Half of the mold cavity is formed by a cavity section 162 (FIG. 5) in the mold section 142. The other half of the article mold cavity is formed by a cavity section 164 in the mold section 144. The connector section 152 contains a cylindrical connector passage which is formed by passage sections 164 and 166 formed in the mold sections 142 and 144. Although only a pair of mold sections 142 and 144 have been shown in FIG. 5 to form a single mold 104 (FIG. 6), it should be understood that a plurality of molds 104 are formed by interconnecting shell sections having the same construction as the shell sections 142 and 144.

Figure 7:
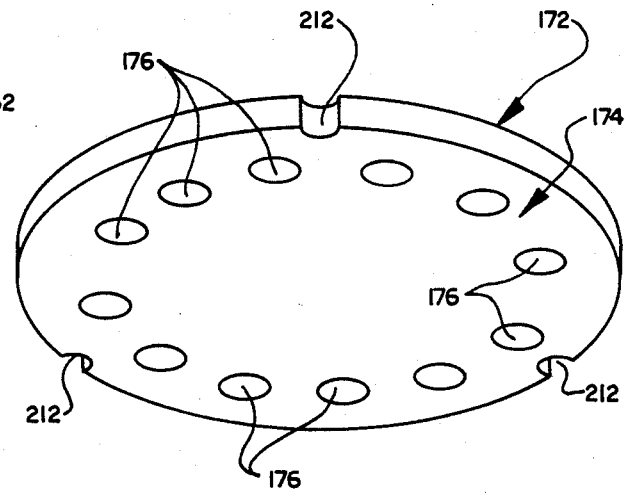
FIG. 7 is a view of a mold support plate used to support a plurality of the molds shown in FIG. 6.

The completed molds 104 are mounted in a circular array on a circular mold support plate 172 (FIG. 7). The mold support plate 172 contains a circular array 174 of holes 176 which are sized to receive the chill cavity end sections 148 (FIG. 6) of the molds 104. Thus, the chill cavity end section 148 of a mold 104 is inserted into one of the openings 176 in the support plate 172 (FIG. 8) and held in place with a suitable cement, indicated at 180. A mold 104 is inserted into each of the openings 176. This results in an annular array of molds 104 extending from the support plate 172.

Figure 8:
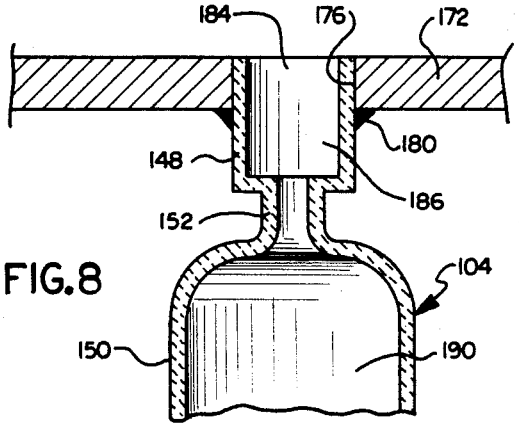
FIG. 8 is an enlarged fragmentary sectional view illustrating the manner in which the mold of FIG. 6 is connected with the support plate of FIG. 7.

The molds 104 are all oriented on the support plate 172 with circular open ends 184 of the chill cavities 186 facing upwardly (as viewed in FIG. 8). Open ends 188 (see FIG. 6) of article mold cavities 190 (FIG. 8) face in the opposite direction, that is, downwardly as viewed in FIG. 8. The mold support plate 172 with the molds 104 mounted thereon is now ready for mounting on the chill assembly 106.

Chill Assembly

Figure 9:
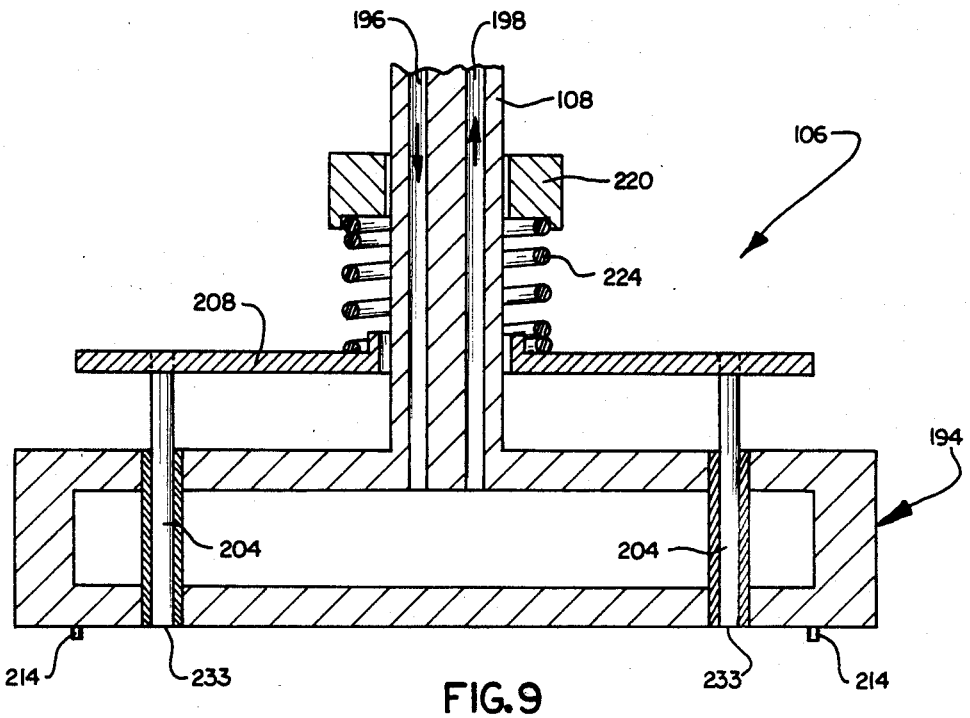
FIG. 9 is a fragmentary schematic sectional view of a chill assembly having a plurality of chill members.

The construction of the chill assembly 106 is illustrated in FIG. 9. The chill assembly 106 includes a hollow circular base or chill plate 194 which is connected with the downwardly extending support rod 108. During a casting operation, relatively cold liquid flows through a passage 196 in the support rod 108 into the hollow chill plate 194. After flowing around a series of baffles in the hollow chill plate 194, the cooling fluid exits from the hollow chill plate through a passage 198 formed in the support rod 108.

A plurality of cylindrical chill members 204 extend through the chill plate 194. Although only a pair of chill members 204 have been shown in FIG. 9, it should be understood that the number of chill members 204 is equal to the number of openings 176 formed in the mold support plate 172. The chill members 204 are arranged in a circular array having the same diameter and circumferential spacing as the circular array in which the openings 176 are arranged in the mold support plate 172.

The chill members 204 are connected with a movable circular mounting plate 208 which is coaxial with the cylindrical support rod 108. While the chill members 204 are in the retracted position shown in FIG. 9, the mold support plate 172 is mounted on the chill plate 194 with the openings 176 in the mold support plate 172 axially aligned with the chill members 204. Thus, a plurality of locating notches 212 are formed in the mold support plate 172 (FIG. 7) and engage outwardly extending locating pins 214 (FIG. 9) connected to the chill plate 194. The mold support plate 172 is clamped or bolted to the chill plate 194 and held against axial movement relative to the chill plate. The pins 214 cooperate with the locating notches 212 to hold the mold support plate 172 against rotational movement relative to the chill plate 194.

Figure 10:
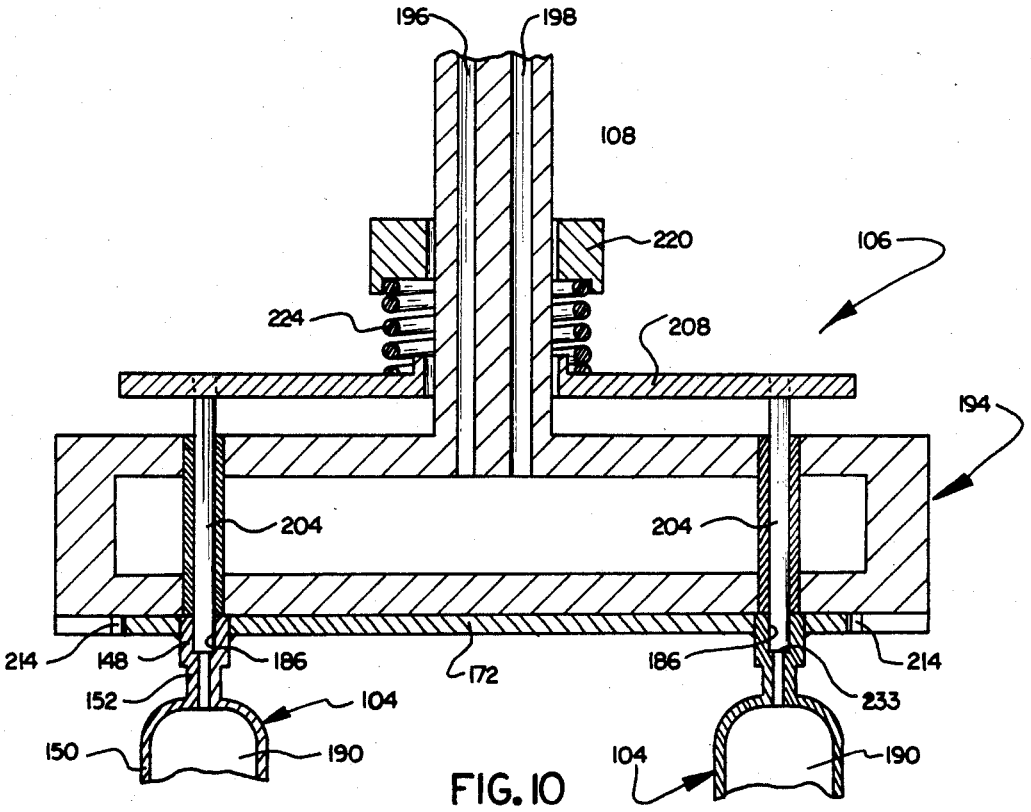
FIG. 10 is a fragmentary sectional view, generally similar to FIG. 9, illustrating the manner in which the mold support plate of FIG. 7 is connected with the chill assembly.

Once the mold support plate 172 and molds 104 have been mounted on the chill plate 194 in the manner shown in FIG. 10, the chill mounting plate 208 is moved downwardly to move the chill members 204 into the upwardly opening chill cavities 186 in the molds 104. The chill mounting plate 208 and chills 204 are moved downwardly by moving a collar 220 downwardly from the position shown in FIG. 9 to the position shown in FIG. 10 along the support post 108. As the collar 220 is moved downwardly by a suitable toggle mechanism or other device (not shown), the chills 204 move into the chill cavities 186 in the molds 104.

When the leading or lower ends of the chills 204 have engaged the lower ends of the chill cavities 186, downward movement of the chill members 204 is stopped. A spring 224 between the collar 220 and chill mounting plate 208 is slightly compressed to maintain a gentle force on the chill members 204 urging them into the chill cavities 186 in the molds 104.

Production Casting Method

When a plurality of articles are to be simultaneously cast in a plurality of molds 104, the molds are first mounted on the ceramic support plate 172. The molds and support plate are preheated to a temperature which is close to the temperature of the superheated body 122 of molten metal in a crucible 78 (see FIG. 4). With the isolation valve 98 and vacuum control valve 114 closed, the door 99 to the loading chamber 96 is opened. The preheated support plate 172 and molds 104 are then secured to the chill assembly 106 with the open ends of the mold cavities 190 facing downwardly and the open ends of the chill cavities 186 facing upwardly. The chills 204 are then moved from the retracted position of FIG. 9 to the extended position of FIG. 10 in which they extend into chill cavities.

The door 99 to the loading chamber 96 is then closed. The vacuum control valve 114 is opened while the valve 138 is closed to thereby evacuate the closed loading chamber 96. Once the loading chamber 96 has been evacuated, the isolation valve 98 is opened.

Before the molds 104 are immersed in the body 122 of molten metal, the output from a thermocouple 232 (FIG. 4) is checked to be certain that the molten metal has been superheated to the desired temperature. Assuming that the molten metal has been superheated to the desired temperature, the chill assembly 106 and molds 104 are lowered. As the molds 104 are lowered, they move through the openings 118 in the baffle plate 120 into the body 122 of molten metal.

As the molds 104 enter the body 122 of molten metal, the molten metal flows upwardly through the open ends 188 (see FIG. 6) of the article mold cavities 190. Continued downward movement of the chill assembly 106 results in the molten metal 122 filling the article mold cavities 190. After a slight pause during which the mold is brought up to the same temperature as the superheated body 122 of molten metal, the downward movement of the chill assembly 106 is continued. The molten metal 122 then moves upwardly through the connector section 152 until it engages the lower end of the chill members 204. After a slight pause, the chill assembly 106 is slowly raised and the molds 104 are moved upwardly. As the molds 104 are moved upwardly, elongated columnar grains are nucleated from the lower end surfaces 233 of the chills 204. These columnar grains enter the mold cavity 190 and result in the solidification of an article having an elongated columnar grain crystallographic structure.

Continued upward movement of the chill assembly 106 moves the molds 104, with solidified articles in the mold cavities 190, through the isolation valve 98 back into the loading chamber 96 (FIG. 4). The isolation valve 98 and vacuum control valve 114 are then closed. Vent valve 138 is then opened and the loading chamber 96 is opened. The mold support plate 172, with the molds 104 thereon, is disconnected from the chill assembly 106 and removed from the loading chamber 96. The cast articles are then removed from the molds 104 and processed.

Figure 12:
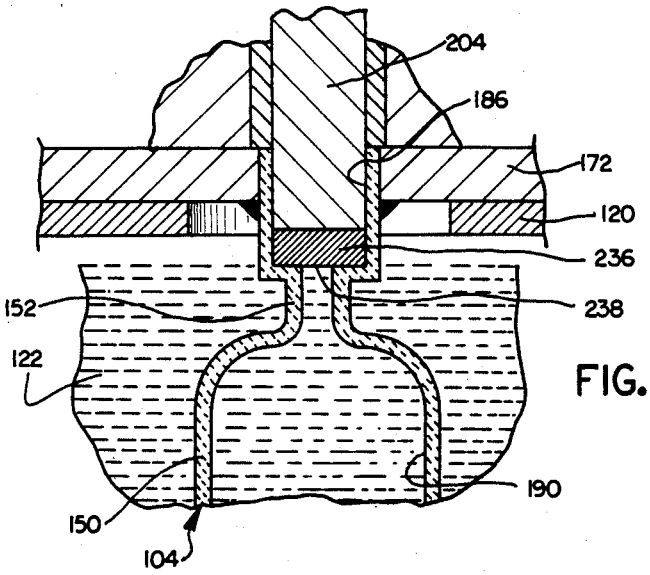
FIG. 12 is an enlarged fragmentary sectional view, generally similar to FIG. 11, illustrating the manner in which a seed crystal is placed between a chill and a mold cavity when a single crystal article is to be cast.

Although the process of simultaneously casting a plurality of articles in the molds 104 has been described herein in connection with columnar grain articles, such as airfoils for turbine engines, it is contemplated that other types of articles having a different crystallographic structure could be cast if desired. When the molds 104 are used to cast single crystal articles, it may be desirable to provide a single crystal seed element 236 (see FIG. 12) in association with each of the chill members 204. The end surface 233 of each chill member 204 engages an upper end of a single crystal seed element 236 to cool the seed element.

When the molds 104 are lowered into the body 122 of molten metal, the molten metal engages the lower side surfaces 238 of the seed elements 236. Upon withdrawal of the mold from the body 122 of molten metal, the seed elements 236 initiate the solidification of the metal in the mold cavity 190 as a single crystal having the same crystallographic orientation as the seed elements 236. Instead of providing seed elements 236, it is contemplated that the connector section 152 of the mold 104 could have a size and configuration such as to allow only a single crystal to grow from the chill cavities 186 into the mold cavities 190.

Dispersion of Additives

In order to enhance the operating characteristics of the cast airfoils, it may be desirable to disperse strengthening agents, such as yttrium or other additives, in the molten metal which is solidified in the mold cavities. Since particles of the inert additives tend to float to the surface in the body of molten metal, difficulty may be encountered in obtaining an even dispersion of the additives in the cast article.

In accordance with one of the features of the present invention, additives are dispensed in the mold cavity at a location immediately beneath the interface between molten and solid metal as the mold is withdrawn from the molten metal. Since the mold is raised upwardly at a constant rate, a uniform dispersion of the additive in the cast article is obtained by dispensing the additive at a constant rate into the molten metal immediately beneath the liquidus-solidus interface.

The particles 242 of the additive (FIG. 13) are dispensed from a cylindrical ceramic tube 244 which extends upwardly into the mold cavity 190 in the mold 104. Thus, the ceramic tube 244 is positioned so that it is aligned with the axial center line of the mold 104. Therefore, when the mold 104 is lowered in to the body 122 of molten metal, the mold moves into a telescopic relationship with the ceramic dispenser tube 244.

Shortly before the mold 104 is withdrawn from the body 122 of the molten metal, a ram 246 is moved upwardly to force a cap (not shown) off of the upper end of the ceramic tube 244. The cap sinks to the bottom of the crucible 78. Continued upward movement of the ram forces the additive particles 242 out of the tube 244 into the molten metal in the mold cavity at a location immediately beneath the upper surface 126 of the body 122 of molten metal. This results in the additive 242 being dispersed in the molten metal in the mold cavity 190 immediately beneath the surface 126 of the molten metal.

As the mold 104 is moved upwardly at a constant rate, the ram 246 is also moved upwardly at a constant rate having a magnitude which is a function of the speed of movement of the mold 104. As the mold 104 is withdrawn from the body 122 of molten metal, the molten metal immediately above the ceramic tube solidifies with an even dispersion of the additive therein. By adjusting the rate at which the ram 246 is moved upwardly relative to the tube 244, the rate at which the additive 242 is dispensed from the tube can be adjusted to obtain a desired mean interparticle spacing of the additive in the cast product.

SUMMARY

When an article is to be cast by the method of the present invention, a mold 20 is lowered into a body 22 of molten metal with the open end of the mold cavity 26 facing downwardly (FIGS. 1–3). This results in the mold cavity filling with molten metal as the mold 20 is lowered. After thermal equilibrium has been obtained between the molten metal 22 and the mold 20, the mold is slowly withdrawn from the body of molten metal. As the mold is withdrawn, the molten metal solidifies in the mold cavity 26 to form the cast article. To provide for controlled solidification of the molten metal in the mold cavity 26, the level of the upper surface 30 of the body 22 of molten metal is maintained substantially constant as the mold is withdrawn from the body 22 of molten metal.

Figure 13:
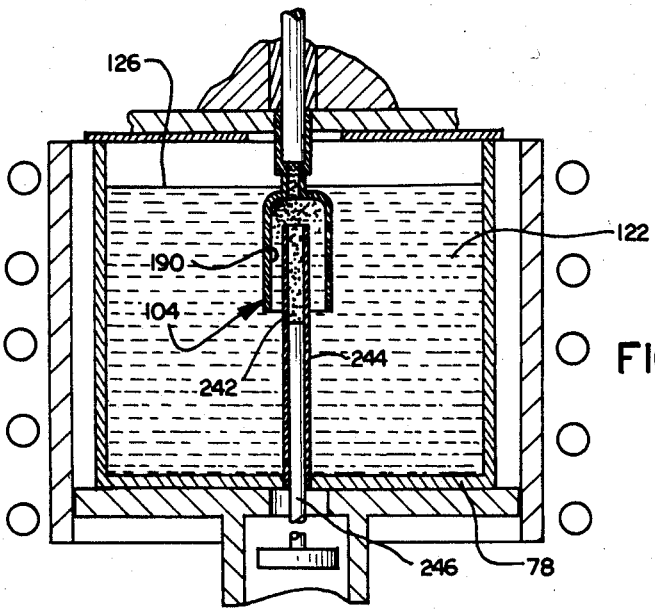
FIG. 13 is a fragmentary schematic illustration of the manner in which an additive is dispensed into molten metal in a mold cavity immediately beneath an interface between the molten metal and solid metal in the mold cavity.

The characteristics of the resulting casting may be enhanced by additives 242 dispensed into the molten metal in the mold cavity 190 (FIG. 13). The additives 242 are dispensed into the molten metal to form a dispersoid immediately beneath the surface 126 of the molten metal in the mold cavity 190 as the mold 104 is withdrawn from the body 22 of molten metal. This results in an even dispersion of the additive in the metal which solidifies as the mold 104 is withdrawn from the body of molten metal.

Figure 11:
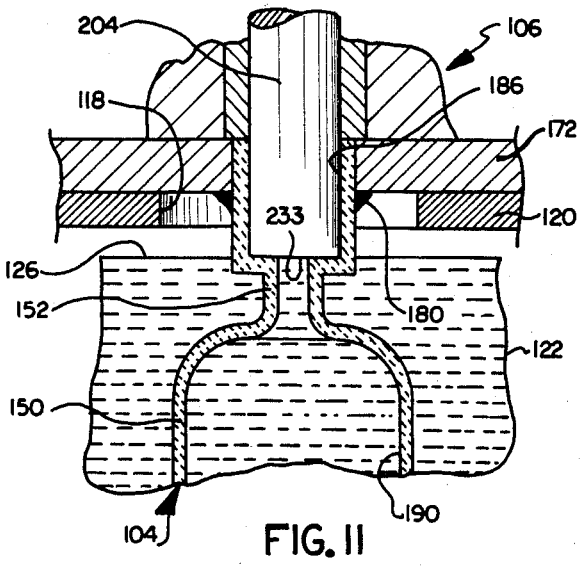
FIG. 11 is an enlarged fragmentary schematic illustration depicting the relationship between a chill member, a mold and a body of molten metal after the mold has been lowered into the body of molten metal.

In order to obtain economical production of castings, a plurality of articles may be simultaneously cast. When this is done, a plurality of molds 104 (FIG. 4) are connected to a mold support member or plate 172 with open ends of chill cavities 186 (FIG. 8) facing in one direction and open ends of mold cavities 190 facing in the opposite direction. The mold support member 172 is then connected to a chill assembly 106 (FIGS. 9 and 10) with an end portion of a chill 204 extending into each of the molds. The mold cavities 190 are then filled with molten metal (FIG. 11) and the chills 204 are cooled to promote solidification of the molten metal in a direction away from the chills.

Having described specific preferred embodiments of the invention, the following is claimed:

1. A method of casting an article, said method comprising the steps of providing a mold having an open ended cavity with a configuration corresponding to the configuration of the article to be cast, providing a body of molten metal, lowering the mold into the body of molten metal with the open end of the mold cavity facing downwardly to fill the mold cavity with molten metal, withdrawing the mold form the body of molten metal, maintaining the level of an upper surface of the body of molten metal substantially constant as the mold is withdrawn from the body of molten metal, said step of maintaining the level of the body of molten metal constant as the mold is withdrawn from the body of molten metal includes the step of lowering into the body of molten metal a makeup body having a cross sectional volume which varies from the lower end of the makeup body to the uper end portion of the makeup body in the same manner as in which the cross sectional volume of the mold varies from the upper end of the portion of the mold in the body of molten metal to the lower end of the mold, and solidifying the molten metal in the mold cavity with the open end of the mold cavity facing downwardly and while performing said step of withdrawing the mold from the body of molten metal.

2. A method as set forth in claim 1 further including the step of melting the makeup body as it is lowered into the body of molten metal.

3. A method as set forth in claim 1 further including the step of withdrawing the makeup body from the body of molten metal after the mold has been withdrawn from the body of molten metal.

4. A method as set forth in claim 1 further including the steps of providing a solid body of metal in the mold and engaging the solid body of metal with the molten metal during completion of said step of lowering the mold into the body of molten metal.

5. A method as set forth in claim 4 wherein said step of providing a solid body of metal in the mold includes the step of providing a body of metal which is a single crystal, said step of solidifying the molten metal in the mold cavity includes the step of solidifying the molten metal to form a single crystal article in the mold cavity.

6. A method as set forth in claim 4 wherein said step of providing a solid body of metal in the mold includes the step of providing a chill member in the mold, said step of solidifying the molten metal in the mold cavity includes the step of conducting heat through the chill member at a greater rate than heat is conducted through side portions of the mold disposed above the body of molten metal, said step of solidifying the molten metal includes the step of solidifying the molten metal as a plurality of elongated columnar grains which extend downwardly from the chill member toward the lower end of the mold cavity.

7. A method as set forth in claim 1 wherein said step of providing a mold includes providing a mold having a mold cavity with an opening at one end of the mold and a chill cavity having an opening at another end of the mold, said method further including the step of inserting a chill member into the chill cavity, said step of lowering the mold into the body of molten metal includes lowering the mold with the chill member extending from the upper end of the mold, said method further including the step of cooling the chill member while performing said step of solidifying the molten metal in the mold cavity.

8. A method as set forth in claim 1 further including the step of providing a baffle plate over the top of the body of molten metal, said step of lowering the mold into the body of molten metal includes the step of moving the mold through an opening in the baffle plate.

9. A method as set forth in claim 1 wherein said step of lowering the mold into the body of molten metal includes lowering the mold into the body of molten metal while the mold is at a temperature which is below the temperature of the molten metal, said step of withdrawing the mold from the body of molten metal being performed after the mold has been heated to substantially the same temperature as the body of molten metal.

10. A method as set forth in claim 1 further including the step of inserting a material into the molten metal in the mold cavity at a rate which is a function of the rate at which the mold is withdrawn from the body of molten metal during performance of said step of withdrawing the mold from the body of molten metal to thereby promote an even distribution of the inserted material in at least a portion of the molten metal solidified in the mold cavity.

11. A method as set forth in claim 1 further including the step of positioning the mold and a hollow tubular member with an end portion of the hollow tubular member disposed in the mold cavity at a location beneath the upper surface of the body of molten metal and forcing material out of the end portion of the hollow tubular member into the molten metal in the mold cavity as the mold is withdrawn from the body of molten metal while maintaining the end portion of the tubular member beneath the surface of the molten metal in the mold cavity.

12. A method as set forth in claim 1 further including the step of adding material to the molten metal in the mold cavity as the mold is withdrawn from the molten metal to form a dispersoid in the mold cavity.

13. A method of casting an article, said method comprising the steps of providing a mold having a mold cavity with a configuration corresponding to the configuration of the article to be cast and with a first end and an open second end, lowering the mold into a body of molten metal with the open second end of the mold facing downwardly to fill the mold cavity with molten metal through the open second end of the mold cavity, withdrawing the mold from the body of molten metal to effect solidification of the molten metal in the mold cavity at an interface which moves from the first end of the mold cavity toward the second end of the mold cavity, and dispensing an additive material into the molten metal in the mold cavity as the interface moves from the first end of the mold cavity to the second end of the mold cavity to disperse the additive material into the molten metal immediately before it solidifies, said step of dispensing additive material into the molten metal includes the step of introducing the additive material directly into the molten metal at a location which is disposed in the mold and is beneath the interface as the interface moves from the first end of the mold cavity to the second end of the mold cavity.

14. A method of casting an article, said method comprising the steps of providing a mold having an open ended cavity with a configuration corresponding to the configuration of the article to be cast, providing a body of molten metal, lowering the mold into the body of molten metal with the open end of the mold cavity facing downwardly to fill the mold cavity with molten metal, withdrawing the mold from the body of molten metal, maintaining the level of an upper surface of the body of molten metal substantially constant as the mold is withdrawn from the body of molten metal, said step of maintaining the level of the body of molten metal constant as the mold is withdrawn includes the step of adding metal to the body of molten metal by lowering a makeup body of solid metal into the body of molten metal at a rate which varies as a function of the rate of withdrawal of the mold from the body of molten metal, and solidifying the molten metal in the mold cavity with the open end of the mold cavity facing downwardly and while performing said step of withdrawing the mold from the body of molten metal.

15. A method as set forth in claim 14 further including the step of providing a baffle plate over the top of the body of molten metal, said step of withdrawing the mold from the body of molten metal includes the step of moving the mold through an opening in the baffle plate, said step of lowering a makeup body of metal into the body of molten metal includes the step of moving the makeup body of metal downwardly through a second opening in the baffle plate while the mold is moving upwardly through the first opening.

16. A method as set forth in claim 14 further including the step of inserting a material into the molten metal in the mold cavity at a rate which is a function of the rate at which the mold is withdrawn from the body of molten metal during performance of said step of withdrawing the mold from the body of molten metal to thereby promote an even distribution of the inserted material in at least a portion of the molten metal solidified in the mold cavity, said step of inserting material into the molten metal in the mold cavity includes the step of introducing the material directly into the molten metal at a location which is disposed in the mold at a predetermined distance below the upper surface of the body of molten metal.

17. A method as set forth in claim 14 further including the step of positioning the mold and a hollow tubular member with an end portion of the hollow tubular member disposed in the mold cavity at a location beneath the upper surface of the body of molten metal and forcing material out of the end portion of the hollow tubular member into the molten metal in the mold cavity as the mold is withdrawn from the body of molten metal while maintaining the end portion of the tubular member beneath the surface of the molten metal in the mold cavity.

18. A method of casting an article, said method comprising the steps of providing a mold having an open ended cavity with a configuration corresponding to the configuration of the article to be cast, providing a body of molten metal, lowering the mold into the body of molten metal with the open end of the mold cavity facing downwardly to fill the mold cavity with molten metal, withdrawing the mold from the body of molten metal, maintaining the level of an upper surface of the body of molten metal substantially constant as the mold is withdrawn from the body of molten metal, inserting an additive material into the molten metal in the mold cavity during performance of said step of withdrawing the mold from the body of molten metal to thereby promote an even distribution of the additive material in at least a portion of the molten metal in the mold cavity, said step of inserting an additive material into the molten metal in the mold cavity includes the step of introducing the additive material directly into the molten metal at a location which is disposed in the mold at a predetermined distance below the upper surface of the body of molten metal, and solidifying the molten metal in the mold cavity with the open end of the mold cavity facing downwardly and while performing said step of withdrawing the mold from the body of molten metal.

19. A method as set forth in claim 18 wherein said step of inserting an additive material into the molten metal in the mold cavity includes forcing additive material out of an end portion of a hollow tubular member directly into the molten metal in the mold cavity as the mold is withdrawn from the body of molten metal and while the end portion of tubular member is at least partially surrounded by the molten metal in the mold cavity.

20. A method of casting an article, said method comprising the steps of providing a mold having a mold cavity with a configuration corresponding to the configuration of the article to be cast and with a first end and an open second end, filling the mold cavity with molten metal through the open second end of the mold cavity, inserting a hollow rod through the open second end of the mold cavity to a position in which an end of the rod is at least partially immersed in the molten metal in the mold cavity and is adjacent to the first end of the mold cavity, solidifying the molten metal in the mold cavity at an interface which moves from the first end of the mold cavity toward the second end of the mold cavity, maintaining the immersed end of the rod adjacent to the interface as the molten metal solidifies by decreasing the extent to which the rod extends into the mold cavity as the interface moves from the first end of the mold cavity to the second end of the mold cavity, and forcing an additive material from the immersed end of the rod directly into the molten metal in the mold cavity at a location adjacent to the interface as the extent to which the rod extends into the mold cavity is decreased and the interface moves from the first end of the mold cavity to the second end of the mold cavity to disperse the additive material into the molten metal immediately before it solidifies.

21. A method as set forth in claim 20 wherein said step of filling the mold cavity with molten metal includes the step of lowering the mold into a body of molten metal with the open second end of the mold facing downwardly.

22. A method as set forth in claim 21 wherein said step of decreasing the extent to which the rod extends into the mold cavity includes withdrawing the mold from the body of molten metal.

* * * * *